United States Patent [19]

Yaguinuma

[11] 4,050,232

[45] Sept. 27, 1977

[54] CONSTRUCTION OF A FRAME OF A DIGITAL CLOCK

[75] Inventor: Jusuke Yaguinuma, Tokyo, Japan

[73] Assignee: Copal Company Limited, Tokyo, Japan

[21] Appl. No.: 692,239

[22] Filed: June 2, 1976

[30] Foreign Application Priority Data

June 5, 1975 Japan ..... 50-75299[U]

[51] Int. Cl.[2] ..... G04C 21/04; G04B 29/02

[52] U.S. Cl. ..... 58/52 R; 58/16 D; 58/38 R

[58] Field of Search ..... 58/23 R, 39.5, 50 R, 58/52, 55, 125 C

[56] References Cited

U.S. PATENT DOCUMENTS

| | | | |
|---|---|---|---|
| 3,609,956 | 10/1971 | Funaki | 58/16 D |
| 3,636,699 | 7/1970 | Marble | 58/16 D |
| 3,953,965 | 5/1976 | Tobeta | 58/38 R |

*Primary Examiner*—E. S. Jackmon

*Attorney, Agent, or Firm*—Haseltine, Lake & Waters

[57] ABSTRACT

A digital clock in which a frame member has two opposite side end plates integrally molded with a base plate of the frame member and a separate partition plate detachably secured in position to the frame member between the two side end plates. The digital clock comprises a preliminarily assembled assembly consisting of at least an indicating flap drum and a timer setting drum supported by a driving shaft with a predetermined axial play existing between the timer setting drum and the indicating flap drum before the assembly is mounted in the frame member. Thus, the assembly can be mounted in the frame member by first inserting one end of the shaft through one of the two side end plates and then inserting the other end of the shaft through the other side end plate so as to be journaled thereby. The axial play of the assembly is removed by securing the separate partition plate to the frame member between the timer setting drum and the indicating flap drum so that the assembling of the digital clock is easily completed while the number of parts for forming the frame is held to a minimum.

3 Claims, 4 Drawing Figures

CONSTRUCTION OF A FRAME OF A DIGITAL CLOCK

BACKGROUND OF THE INVENTION

The present invention relates to improvements in the construction of a frame of a digital clock, and more particularly to the construction of a frame of a digital clock which comprises very few parts and which enables the assembling of the digital clock to be very simple.

The frame of a digital clock of the prior art comprises a number of parts made of metal sheets and the like which must be assembled together by means of a number of set screws or caulking thereby requiring troublesome operations and a high cost of production.

The present invention aims at avoiding the above described disadvantages of the prior art frame construction of the digital clock.

SUMMARY OF THE INVENTION

The object of the present invention is to provide a novel and useful construction of a frame a digital clock which is very simple and easy to assemble so that it is very inexpensive to manufacture while a high accuracy in the operation is insured.

The above object is achieved in accordance with the present invention by the provision of a frame of a digital clock having a preliminarily assembled assembly consisting of at least an indicating flap drum and a timer setting drum supported on a driving shaft and adapted to be mounted in the frame. The frame comprises a frame member having two opposite side end plates integrally formed with a base plate of the frame member and a separate partition plate adapted to be detachably secured in position between the two side end plates. The assembly has a certain axial play between the indicating flap drum and the timer setting drum before it is mounted in the frame member thereby permitting it to be mounted between the two side end plates. This is accomplished by first inserting one of the opposite ends of the driving shaft through one of the side end plates and thereafter inserting the other end through the other side end plate so as to be journaled thereby. The separate partition plate is to be attached in position to the frame member between the timer setting drum and the indicating flap drum so as to complete the assembling of the digital clock with the axial play being removed by the partition plate.

The number of essential parts of the frame of the present invention is thereby only two, i.e., the integrally formed frame member and the partition plate.

In accordance with another feature of the present invention, the frame member and the partition plate are formed of a plastic material integrally molded, so that the manufacture of the frame member and the partition plate is made extremely simple and inexpensive while the dimensional accuracy thereof is insured.

In order to insure accurate positioning of the partition plate in the frame member in accordance with the present invention, the partition plate is provided with positioning lugs formed at appropriate positions thereon. The frame member is provided with mating positioning recesses releasably engageable with the positioning lugs of the partition plate, thereby insuring the partition plate to be detachably secured to the frame member in proper position relative thereto.

The assembling of the digital clock is thus made extremely simple to render the cost to be low while a high accuracy in operation is insured.

DETAILED DESCRIPTION OF THE PREFERRED EMBODIMENT

Figure 1:
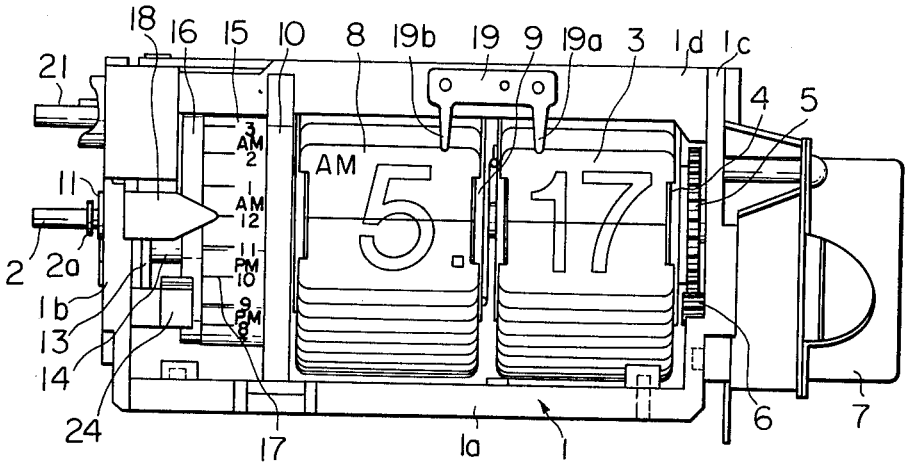
FIG. 1 is a front view showing a digital clock incorporating the frame constructed in accordance with the present invention.

Referring now to FIG. 1, the digital clock incorporating the frame of the present invention comprises a frame member 1 having a base plate 1*a* and two opposite side end plates 1*b*, 1*c* integrally formed with the base plate 1*a* which are preferably molded from a plastic material. A driving shaft 2 is rotatably journaled by the side end plates 1*b*, 1*c*. A minute drum 4 having a plurality of minute flaps 3 pivotally supported along the periphery of the drum 4 is secured to the shaft 2 so as to be rotated therewith at a predetermined speed through a unidirectional clutch (not shown) by a reduction gear 5 which meshes with a pinion 6 of a driving motor 7 mounted on the outer surface of the side end plate 1*c* so as to be driven thereby. The respective minute flap 3 is successively released from a stopper arm 19*a* of a stopper member 19 secured to a stay 1*d* spanning between the side end plates 1*b*, 1*c*. As the drum 4 rotates, a minute of time is switchingly indicated by the minute flaps 3.

Figure 2:
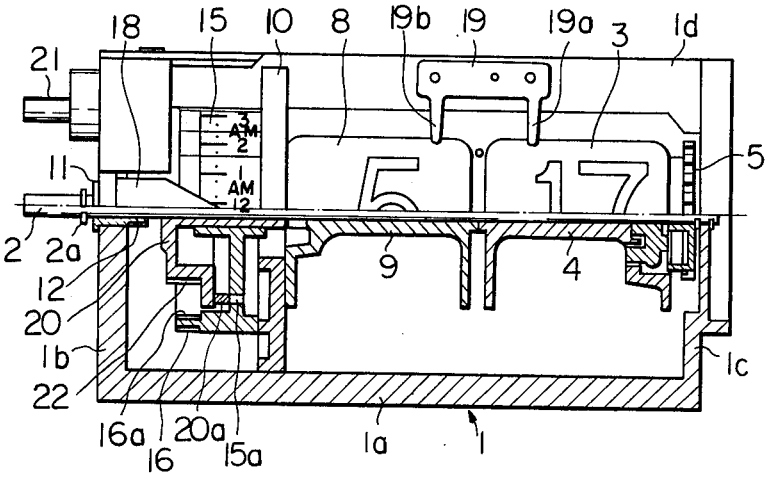
FIG. 2 is a front view similar to FIG. 1 with the lower half portion thereof being shown as a sectional view and with the driving motor being removed.

An hour drum 9 having a plurality of hour flaps 8 pivotally supported along the periphery of the hour drum 9 is rotatably mounted on the driving shaft 2 adjacent to the minute drum 4. A timer setting drum 15 is arranged on the driving shaft 2 with a partition plate 10, which is to be described later in detail, being interposed between the hour drum 9 and the timer setting drum 15. As shown in FIG. 2, the timer setting drum 15 is rotatably supported on an inner collar of a clutch plate 20 which is rotatably and axially shiftably supported on the driving shaft 2. The clutch plate 20 has an outer cylindrical portion having a flange radially extending therefrom and is urged by a spring (not shown), toward the right in FIG. 2 so that the timer setting drum 15 is also urged against the partition plate 10 so as to be held in contact therewith. The spring may be made a resilient actuating member of a switch (not shown) which resiliently urges the clutch plate 20 toward the right and senses the axial position thereof so as to actuate the switch depending upon the axial position of the clutch plate 20.

The timer setting drum 15 has a timer setting scale 17 on the periphery thereof which cooperates with an index 18 mounted on the side end plate 1*b*. The setting of the timer at a desired time is effected by the rotation of the timer setting drum 15. The timer setting drum 15 is formed with a gear 16 at its outer periphery which meshes with a pinion 21*a* (FIG. 3) integrally formed with a manually operable adjusting shaft 21. This permits the timer setting drum 15 to be set at a desired time by manipulating the adjusting shaft 21. In order to releasably maintain the timer setting drum 15 in the set position thereof, ratchet teeth 16*a* are formed on the inner periphery of the timer setting drum 15. One of the ratchet teeth 16*a* engages with a ratchet claw portion 24*a* of a ratchet claw 24 (FIG. 3) pivotally supported at its proximal end by the side end plate 1*b*. In order to maintain the ratchet claw portion 24*a* in resilient engagement with one of the ratchet teeth 16*a* of the timer setting drum 15, the ratchet claw 24 is provided with a resilient ratchet biasing arm 24*b* integrally formed therewith. A ratchet biasing arm 24*b* resiliently urges the outer periphery of the timer setting drum 15 radially inward thereof so that the ratchet claw portion 24*a* in turn resiliently urges the ratchet teeth 16*a* radially outward thereof by the reaction force of the biasing arm 24*b*.

The end of the driving shaft 2 opposite to that adjacent to the motor 7 is rotatably supported by a hole formed in the side end plate 1*b* through a sleeve 11 detachably and rotatably fitted in the hole. The sleeve 11 has a D-shaped hole slidably fitted with a D-shaped cross-sectional portion of the driving shaft 2 so as to be rotated therewith but detachable therefrom. A stopper ring 2*a* fitted on the driving shaft 2 prevents the sleeve 11 from being detached from the shaft 2.

Figure 3:
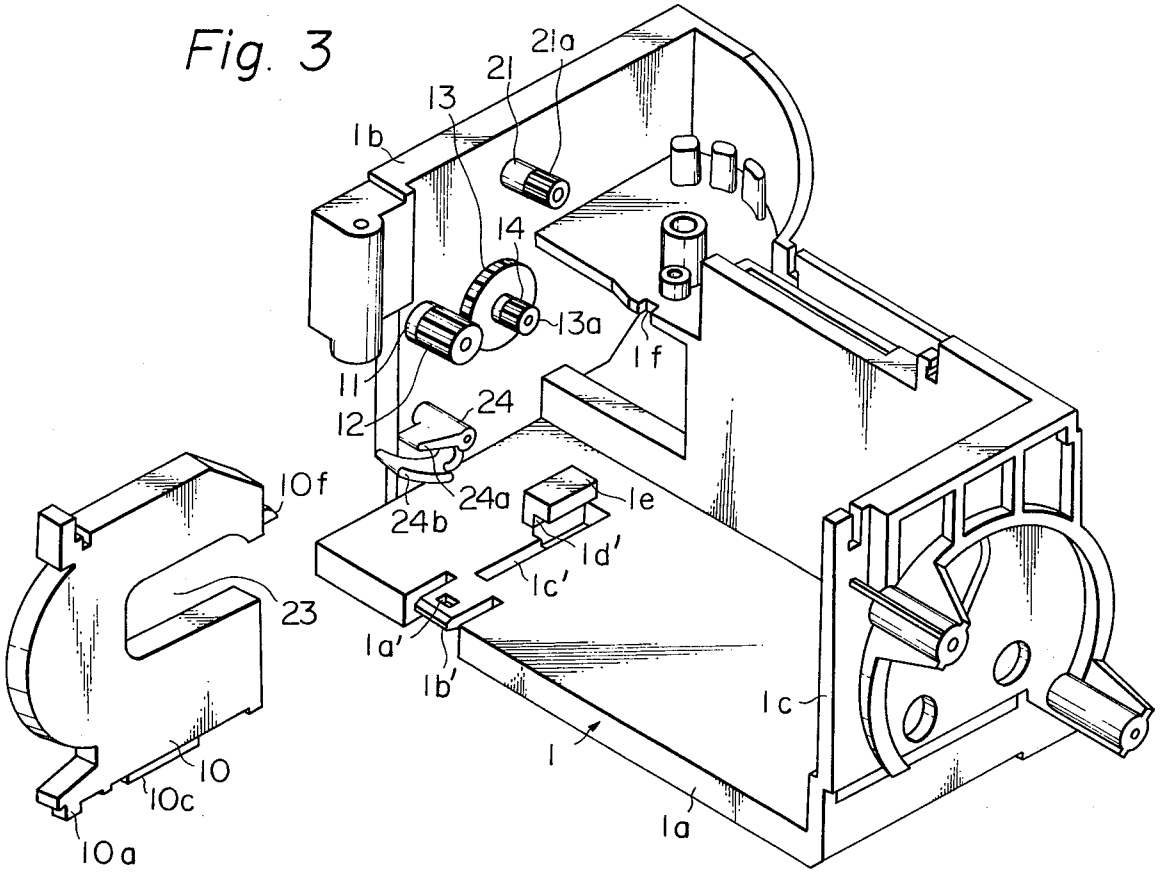
FIG. 3 is an exploded perspective view showing the frame member and the partition plate of the present invention.

A pinion 12 is formed on the sleeve 11 as shown in FIG. 3. The pinion 12 meshes with a gear 13 rotatably supported on the side end plate 1*b* by a shaft 132. A pinion 14 integral with the gear 13 meshes with a gear 22 formed on the cylindrical portion of the clutch plate 20 (FIG. 2) so that the clutch plate 20 is rotated at a predetermined reduced speed by the rotation of the driving shaft 2. The clutch plate 20 is coupled with the hour drum 9 via a coupling (not shown) so that the hour drum 9 is also rotated together with the clutch plate 20 by the driving shaft 2.

The respective hour flap 8 is successively released from the stopper arm 19*b* formed on the stopper member 19 as the hour drum 9 rotates so as to indicate the hour in timed relation with the actuation of the minute flaps 3 indicating the minute. To this end, a synchronizing switching coupling means (not shown) is arranged between the minute flaps 3 and the hour flaps 8 so that the respective hour flap 8 is switched in synchronized relation with the switching of the last one of the series of the minute flaps 3 so as to exactly indicate the time in terms of the hour and the minute.

A timer setting cam 20*a* (FIG. 2) is provided on the clutch plate 20 extending from the side facing against the timer setting a mating arcuate recess 15*a* having a predetermined length is formed in the timer setting drum 15, so that the cam 20*a* engages with the recess 15*a* when the set time as set by the adjustment of the timer setting drum 15 is reached by the rotation of the clutch plate 20 relative to the timer setting drum 15. The clutch plate 20 is shifted to the right by the action of the resilient actuating member of the switch so as to actuate the same for activating alarm or radio. A selecting mechanism is provided in the switch in the well known manner so that continuing operation of radio or shut-off of alarm or the commencement of operation of radio or alarm at the set time by the timer can be selectively effected.

The characteristic feature of the present invention lies in the construction of the frame of the digital clock as described above. In other words, the frame is constituted by only two parts, i.e., the frame member 1 and the partition plate 10, thereby reducing the number of parts forming the frame is reduced to the minimum so that the production cost is lowered and the assembling is extremely simplified while a high accuracy in operation is maintained by the simple construction of the frame.

As described previously, the frame member 1 comprises the base plate 1*a*, the opposite two side end plates 1*b*, 1*c* and a rear plate integrally molded by a suitable plastic material. The partition plate 10 is also made of a molded plastic material.

Figure 4:
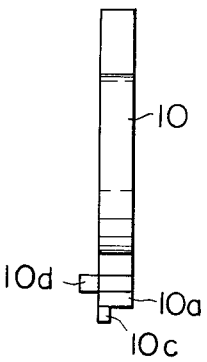
FIG. 4 is an end view showing the partition plate.

In order to detachably secure the partition plate 10 in accurate position to the frame member 1, the partition plate 10 is provided with an arresting lug 10*a*, a lower guide ridge or elongated lug 10*c*, a side guide ridge or side lug 10*d* (FIG. 4) and a positioning lug 10*f* integrally formed on the partition plate 10. A recess 23 is formed in the intermediate portion of the partition plate 10 for receiving therein the driving shaft 2 and other elements of the digital clock.

The frame member 1 is formed with a resilient projection 1*b*′ having an arresting hole 1*a*′ to arrestingly engage with the lug 10*a* when the partition plate 10 is mounted in position in the frame member 1. A guide slot 1*c*′ is used for receiving the lug 10*c* so as to properly position the partition plate 10 axially to the driving shaft 2. An inverted L-shaped projection 1*e* has a groove 1*d*′ for receiving the side lug 10*d* so as to prevent the upward movement of the partition plate 10 and to properly position the same in the vertical direction. A recess 1*f* is used for receiving the lug 10*f* to prevent lateral movement of the partition plate 10. These measures insure the proper positioning of the partition plate 10 relative to the frame member 1 once the partition plate 10 is mounted in the frame member 1.

In assembling the digital clock as described above, the partition plate 10 and the sleeve 11 are first held removed from the frame member 1. An assembly consisting of the minute drum 4, the hour drum 9 and the timer setting drum 15 including the clutch plate 20 supported on the driving shaft 2, respectively, is prepared. A certain axial play exists between the timer setting drum 15 and the hour drum 9 before the partition plate 10 is interposed therebetween which enables the mounting of the assembly in the frame member 1. In order to mount the assembly in the frame member 1, the assembly is first held in oblique position relative to the frame member 1. The left hand end of the driving shaft 2 is positioned within the frame member 1 adjacent to the hole in the left side end plate 1*b*. Then the left hand end of the driving shaft 2 is inserted through the hole so as to project out of the side end plate 1*b*. The gear 16 and the ratchet teeth 16*a* of the drum 15 are engaged with the biasing arm 24*b* and the ratchet claw portion 24*a* of the ratchet claw 24. The gear 22 of the clutch plate 20 is engaged with the pinion 14 while the gear 16 is engaged with the pinion 21*a* of the adjusting shaft 21 by moving the entire assembly in the frame member 1. Then, the right hand end of the driving shaft 2 is inserted in the hole of the right side end plate 1*c* by moving the shaft 2 axially rightward. A stopper ring (not shown) is fitted to the shaft 2 so as to arrest the axial movement thereof. Since the sleeve 11 is removed from the hole of the side end plate 1*b*, the size of the hole is sufficiently large in order to permit the left hand end of the shaft 2 to be first inserted into the hole obliquely. The axial play between the timer setting drum 15 and the hour drum 9 existing before the partition plate 10 is interposed therebetween permits the insertion of the left hand end of the shaft 2 into the hole of the side end plate 1*b* with the assembly being held obliquely to the frame member 1. The drums 15 and 9 are held closely adjacent to each other while the entire assembly is then allowed to be received in the frame member 1.

Then, the sleeve 11 is slid on the driving shaft 2 from the left hand end thereof and fitted in the hole of the side end plate 1*b.* The stopper ring 2*a* is applied to the shaft 2 so as to prevent the sleeve 11 from being removed from the shaft 2.

Thereafter, the partition plate 10 is inserted between the timer setting drum 15 and the hour drum 9 with the guide ridge 10*c* slid into the slot 1*c'* and the side lug 10*d* engaged in the groove 1*d'* while the lug 10*f* is fitted in the recess 1*f.* The arresting lug 10*a* is finally received in the hole 1*a'* so that the partition plate 10 is held in accurate position between the drum 15 and 9 thereby eliminating the axial play therebetween.

The actuating member of the switch is applied to the left hand side of the clutch plate 20.

The assembling of the digital clock is completed by mounting the motor 7 on the side end plate 1*c* with the pinion 6 being meshed with the gear 5.

As described above, the assembling of the digital clock is extremely simplified by virtue of the frame construction of the present invention requiring only two parts, i.e., the frame member 1 and the partition plate 10.

I claim:

1. Construction of a frame of a digital clock having a pre-assembled assembly comprising of at least an indicating flap drum and a timer setting drum supported on a driving shaft and adapted to be mounted in said frame, said frame comprising: a frame member having opposite two side end plates integrally formed with a base plate of said frame member and a separate partition plate adapted to be detachably secured in position between said two side end plates, said assembly having a predetermined axial play between said indicating flap drum and said timer setting drum before said assembly is mounted in said frame member for permitting said assembly to be mounted between said two side end plates by first inserting one of the opposite ends of said driving shaft through one of said side end plates and thereafter inserting the other end through the other side end plate so as to be journaled thereby, said separate partition plate being attached in position to said frame member between said timer setting drum and said indicating flap drum for completing the assembling of said digital clock with said axial play being removed by said partition plate.

2. Construction according to claim 1, wherein said frame member and said partition plate are formed of plastic material integrally molded.

3. Construction according to claim 1, wherein said partition plate has positioning lugs formed at appropriate positions thereon, said frame member having mating positioning recesses releasably engageable with said positioning lugs for permitting said partition plate to be detachably secured in position to said frame member.

* * * * *